US009837730B1

(12) United States Patent
Rahman et al.

(10) Patent No.: US 9,837,730 B1
(45) Date of Patent: Dec. 5, 2017

(54) INSULATION PIERCING MEASUREMENT CONNECTORS

(71) Applicant: Tyco Electronics Canada ULC, Markham (CA)

(72) Inventors: Sarzil Rahman, Scarborough (CA); Jonathan Guppy, Markham (CA)

(73) Assignee: Tyco Electronics Canada ULC, Markham, Ontario (CA)

( * ) Notice: Subject to any disclaimer, the term of this patent is extended or adjusted under 35 U.S.C. 154(b) by 0 days.

(21) Appl. No.: 15/384,800

(22) Filed: Dec. 20, 2016

(51) Int. Cl.
*H01R 4/24* (2006.01)
*H01R 13/66* (2006.01)

(52) U.S. Cl.
CPC ..... *H01R 4/2483* (2013.01); *H01R 13/6683* (2013.01)

(58) Field of Classification Search
CPC ..... H01R 4/2483
USPC ..... 439/416, 411, 431, 475, 474
See application file for complete search history.

(56) References Cited

U.S. PATENT DOCUMENTS 3,823,639 A 7/1974 Liber
4,620,755 A * 11/1986 Yonkers ..... H01R 4/2475 174/78
5,945,665 A 8/1999 Hay
6,042,430 A 3/2000 Hollick
6,261,119 B1 * 7/2001 Green ..... H01R 4/2408 439/411
6,875,045 B1 * 4/2005 Hollick ..... H01R 4/363 439/411
7,214,108 B2 5/2007 Barnett
7,824,191 B1 11/2010 Browder
8,433,160 B2 4/2013 Shah et al.
8,550,842 B1 10/2013 Gutierrez et al.
9,147,967 B2 9/2015 Johnson et al.
9,287,673 B2 3/2016 Galla et al.

* cited by examiner

*Primary Examiner* — Phuong Dinh
(74) *Attorney, Agent, or Firm* — Myers Bigel, P.A.

(57) ABSTRACT

An insulation piercing connector includes a connector body, a bolt, a piercing pin, and an insulator member that electrically insulates the piercing pin from the bolt. The connector body includes a cable receiving slot and a threaded bore in communication with the cable receiving slot. The bolt includes a threaded shank with a central bore, and a head joined to the threaded shank by a shear-off section. The piercing pin is supported within the central bore by the insulator member and includes opposite first and second ends. The first end is configured to pierce the insulation of an electrical cable extending through the cable receiving slot and contact a conductor. The central bore of the bolt threadingly receives a sensor. The sensor includes a probe that contacts the second end of the piercing pin to obtain information from the conductor, such as voltage, current, and/or thermal information.

20 Claims, 8 Drawing Sheets

INSULATION PIERCING MEASUREMENT CONNECTORS

FIELD OF THE INVENTION

The present invention relates to electrical cables and, more particularly, to connectors for electrical cables.

BACKGROUND

Conventional insulation piercing connectors are used to form mechanical and electrical connections between insulated cables. Typically, a conventional insulation piercing connector includes metal piercing blades with sets of teeth on either end thereof. The piercing blades are mounted in housing members (e.g., along with environmental sealing components). The housing members are clamped about insulated main and tap cables so that one set of teeth of a piercing blade engages the main cable and the other set of teeth of the piercing blade engages the tap cable. The teeth penetrate the insulation layers of the cables and make contact with the underlying conductors, thereby providing electrical continuity between the conductors through the piercing blade. Conventional insulation piercing connectors can be somewhat complex and cumbersome to install in the field. As such, a need exists for insulation piercing connectors that can be easily and quickly installed in the field without requiring special tools.

SUMMARY

According to embodiments of the invention, an insulation piercing connector for attachment to an insulated electrical cable includes a connector body, a bolt, a piercing pin, and an insulator member that electrically insulates the piercing pin from the bolt. The connector body includes a cable receiving slot that is configured to receive the insulated electrical cable therein, such as an electrical power cable. The connector body also includes a threaded bore that is in communication with the cable receiving slot. Typically, the connector body is formed from electrically insulative material and may have a generally cylindrical configuration or a generally rectangular configuration, although other configurations are possible. However, the connector body may be formed from various materials, such as metal, in some embodiments.

The bolt defines a longitudinal axis and includes a threaded shank, a central bore coincident with the longitudinal axis, and a head that is joined to the threaded shank by a shear-off section. The threaded shank is threadingly engaged with the threaded bore and the head is configured to be sheared off by a torque exceeding a predetermined value as the bolt is rotated in a first (e.g., clockwise) direction. The piercing pin is supported within the central bore of the bolt by the insulator member and includes opposite first and second ends. The first end is configured to pierce the insulation of an electrical cable extending through the cable receiving slot and contact the conductor under the insulation as the bolt is rotated in the first direction. In some embodiments, the threaded bore of the connector body includes a stop that limits travel of the bolt into the connector body, and thereby controls how far the piercing pin can penetrate into an electrical cable.

The central bore of the bolt is threaded and a sensor can be threadingly secured to the threaded bore. The sensor includes a probe that contacts the second end of the piercing pin to obtain information from the conductor, such as voltage, current, and/or thermal information, etc. In some embodiments, the sensor includes an electronic display that is configured to display information obtained from the conductor. The sensor may be removably secured to the connector. In some embodiments, when the sensor is not secured to the connector, a cap is removably secured to the central bore of the bolt and is configured to seal the central bore from exposure to the environment.

According to other embodiments of the present invention, an insulation piercing connector for attachment to an electrical cable includes a connector body, a bolt, and a piercing pin operably associated with the bolt. The connector body includes a cable receiving slot that is configured to receive the insulated electrical cable therein, such as an electrical power cable. The connector body also includes a threaded bore that is in communication with the cable receiving slot. Typically, the connector body is formed from electrically insulative material and may have a generally cylindrical configuration or a generally rectangular configuration, although other configurations are possible. However, the connector body may be formed from various materials, such as metal, in some embodiments.

The bolt defines a longitudinal axis and includes a threaded shank that is threadingly engaged with the central bore of the connector body. The bolt also includes a central bore that is coincident with the longitudinal axis. An electrically insulative bushing is disposed within the central bore of the bolt and includes a threaded bore. The piercing pin includes opposite first and second ends and a threaded intermediate portion between the first and second ends. The threaded intermediate portion is threadingly engaged with the threaded bore of the bushing. The bushing electrically insulates the piercing pin from the bolt. The first end of the piercing pin is configured to pierce the insulation of an electrical cable extending through the cable receiving slot and contact a conductor therein as the piercing pin is rotated in a first (e.g., clockwise) direction.

The threaded bore of the connector body includes a stop that limits travel of the bolt into the connector body. The piercing pin includes a head that is joined to the second end of the piercing pin by a shear-off section. Rotation of the piercing pin head causes the threaded shank of the bolt to threadingly engage with the threaded bore of the connector body until the bolt contacts the stop. Continued rotation of the head causes the first end of the piercing pin to pierce insulation of the electrical cable extending through the cable receiving slot. The head of the piercing pin is configured to be sheared off by a torque exceeding a predetermined value after the first end of the piercing pin contacts the conductor under the insulation.

The central bore of the bolt is threaded and a sensor can be threadingly secured to the threaded bore. The sensor includes a probe that contacts the second end of the piercing pin to obtain information from the conductor, such as voltage, current, and/or thermal, information, etc. In some embodiments, the sensor includes an electronic display that is configured to display information obtained from the conductor. The sensor may be removably secured to the connector. In some embodiments, when the sensor is not secured to the connector, a cap is removably secured to the central bore of the bolt and is configured to seal the central bore from exposure to the environment.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 3:
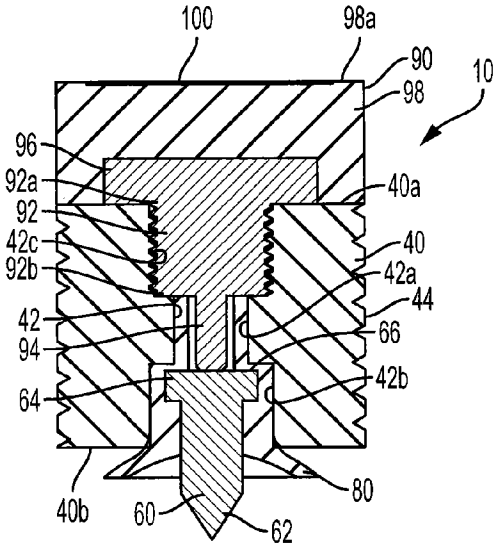
FIG. 3 is a cross-sectional view of the bolt of the insulation piercing connector of FIG. 2 illustrating the piercing pin supported within a central bore of the bolt via an insulator member, and also illustrating a sensor threadingly secured to the threaded bore of the bolt.
Figure 5:
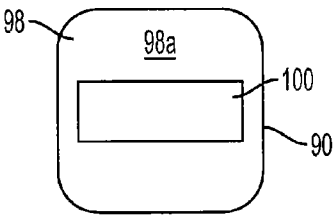
FIG. 5 is a top plan view of the sensor of FIG. 4 taken along line 5-5 of FIG. 4 that illustrates the display.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The term "about", as used herein with respect to a value or number, means that the value or number can vary by +/− twenty percent (20%).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
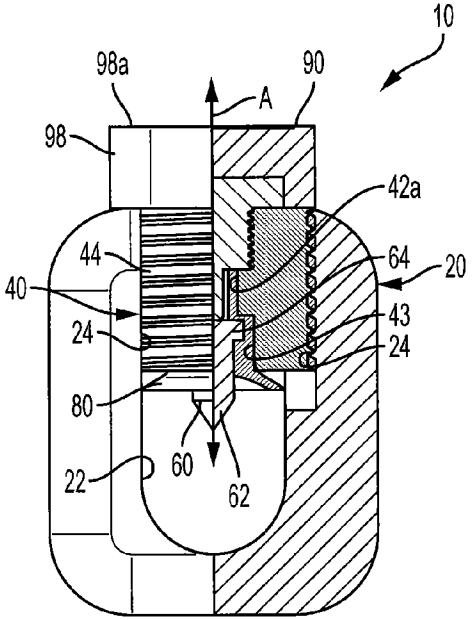
FIG. 2 is a cross-sectional view of the insulation piercing connector of FIG. 1 taken along the line 2-2 of FIG. 1.
Figure 1:
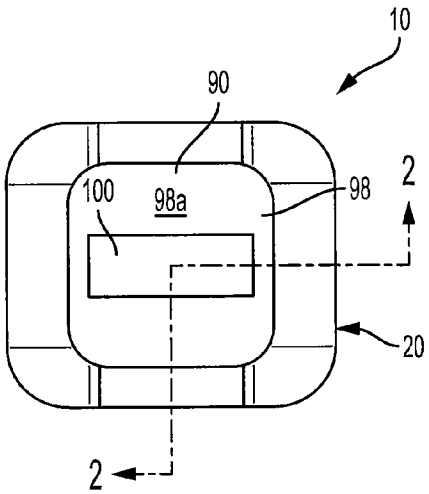
FIG. 1 is a top plan view of an insulation piercing connector for attachment to an electrical cable, according to some embodiments of the present invention.
Figure 4:
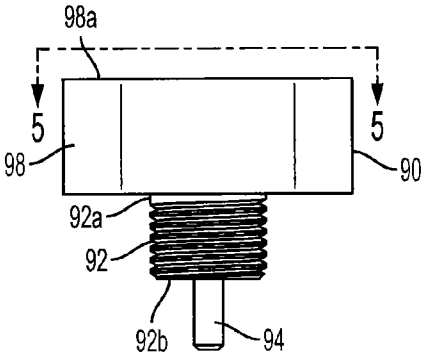
FIG. 4 is a side view of the sensor of FIG. 3.

Referring initially to FIGS. 1-3, an insulation piercing connector 10 for attachment to an electrical cable according to some embodiments of the present invention is shown therein. Exemplary electrical cables with which the connector 10 can be utilized include, but are not limited to, low voltage electrical power cables (e.g., up to about 1000V) and medium voltage electrical power cables (e.g., up to about 65 kV). However, connectors according to embodiments of the present invention may be utilized with various other types of electrical power cables, also. The illustrated connector 10 includes a connector body 20 having an electrical cable receiving slot 22 extending therethrough and a threaded bore 24 communicating with the cable receiving slot 22. A bolt 40 is threadingly engaged with the threaded bore 24 and includes a central bore 42. In the illustrated embodiment of FIGS. 1-3, the central bore 42 has a first portion 42*a* with a first diameter and a second, lower portion 42*b* that has a larger diameter than the first portion 42*a*. The illustrated central bore 42 also has an upper threaded portion 42*c*. A piercing pin 60 is disposed within the central bore 42 of the bolt 40, and an insulator member 80 is disposed within the central bore 42 of the bolt that electrically insulates the piercing pin 60 from the bolt 40. The central bore 42 in the embodiment of FIGS. 1-3 is configured to matingly receive the various insulator member embodiments illustrated in FIGS. 12A-12B, 13A-13B and 14A-14B.

Several embodiments of the connector body 20 are illustrated in FIGS. 6, 6A-6C, 7 and 7A-7C. The connector body 20 illustrated in FIGS. 6 and 6A-6C has a generally cylindrical configuration, and the connector body 20 illustrated in FIGS. 7 and 7A-7C has a generally rectangular configuration. However, a connector body 20 can have various shapes and configurations and is not limited to a generally cylindrical or generally rectangular configuration. In each illustrated embodiment, the connector body 20 includes a cable receiving slot 22 that forms two opposing portions or wings 20*a*, 20*b*. Each wing 20*a*, 20*b* has a respective arcuate threaded wall 24*a*, 24*b* formed therein as illustrated. Together, the arcuate threaded walls 24*a*, 24*b* form the threaded bore 24 of the connector body 20. An electrical cable (e.g., EC, FIG. 24) is inserted within the slot 22 between the two opposing wings 20*a*, 20*b* prior to the bolt 40 being threaded into the threaded bore 24. One or both of the wings 20*a*, 20*b* also includes a wall portion or stop 25 at the bottom of the arcuate threaded wall 24*a*, 24*b*, as illustrated. The stop 25 limits the distance that the bolt 40 can be threaded into the threaded bore 24 of the connector body 20. The connector body 20 may be formed from various materials including electrically insulative materials, as well as various metals.

Figure 6:
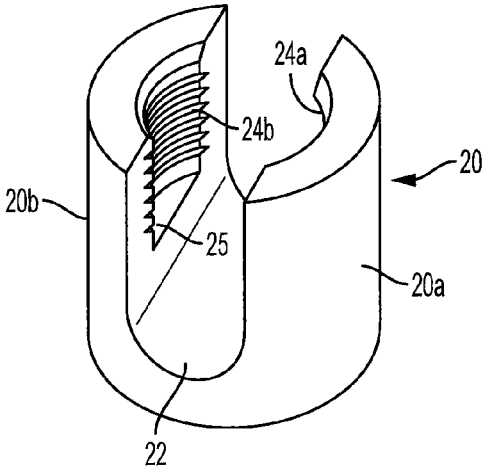
FIG. 6 is a top perspective view of a connector body for an insulation piercing connector, according to some embodiments of the present invention.
Figure 6A:
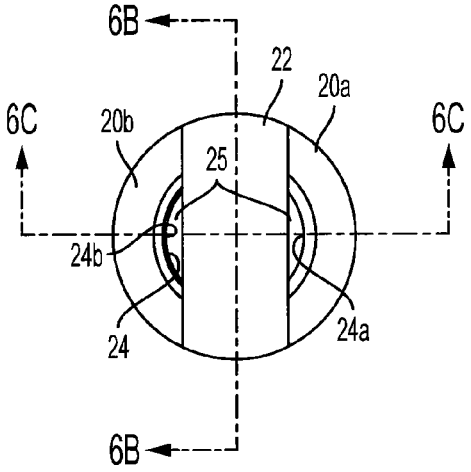
FIG. 6A is a top plan view of the connector body of FIG. 6.
Figure 6B:
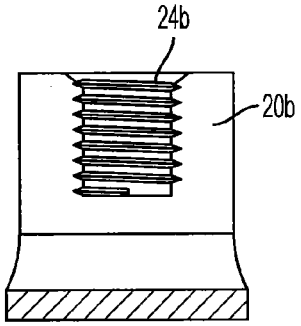
FIG. 6B is a cross-sectional view of the connector body of FIG. 6A taken along line 6B-6B of FIG. 6A.
Figure 6C:
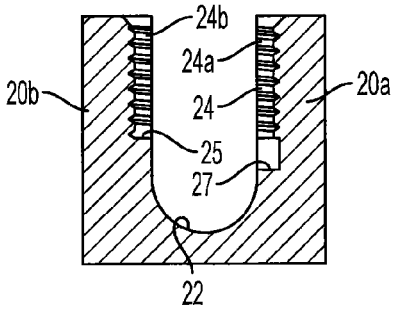
FIG. 6C is a cross-sectional view of the connector body of FIG. 6A taken along line 6C-6C of FIG. 6A.
Figure 7:
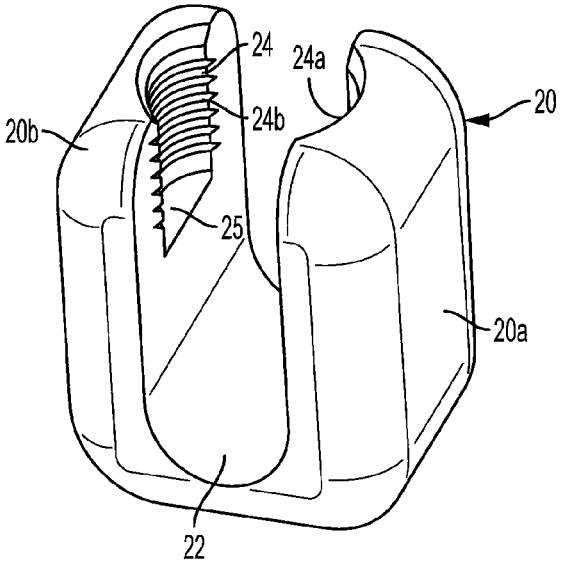
FIG. 7 is a top perspective view of a connector body for an insulation piercing connector, according to some embodiments of the present invention.
Figure 7A:
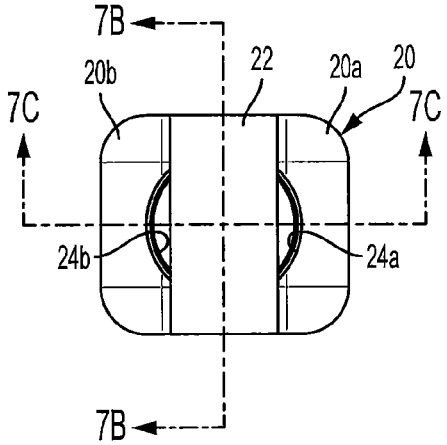
FIG. 7A is a top plan view of the connector body of FIG. 7.
Figure 7B:
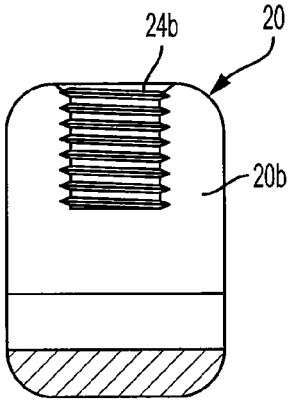
FIG. 7B is a cross-sectional view of the connector body of FIG. 7A taken along line 7B-7B of FIG. 7A.
Figure 7C:
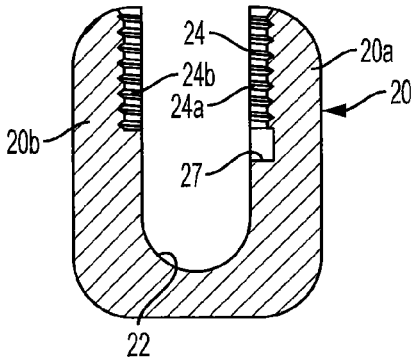
FIG. 7C is a cross-sectional view of the connector body of FIG. 7A taken along line 7C-7C of FIG. 7A.
Figure 11:
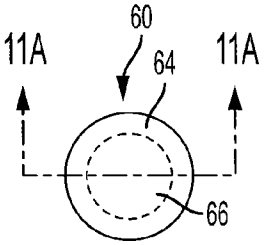
FIG. 11 is a top plan view of a piercing pin that can be utilized with an insulation piercing connector, according to some embodiments of the present invention.
Figure 11A:
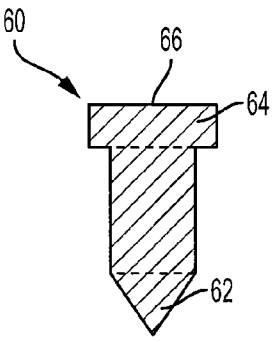
FIG. 11A is a cross-sectional view of the piercing pin of FIG. 11 taken along line 11A-11A of FIG. 11.
Figure 10:
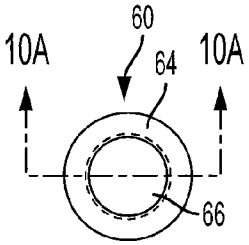
FIG. 10 is a top plan view of a piercing pin that can be utilized with an insulation piercing connector, according to some embodiments of the present invention.
Figure 10A:
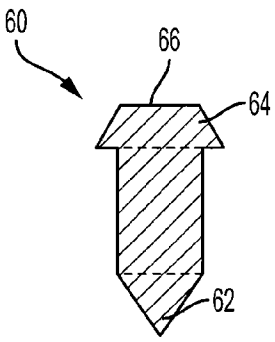
FIG. 10A is a cross-sectional view of the piercing pin of FIG. 10 taken along line 10A-10A of FIG. 10.
Figure 8:
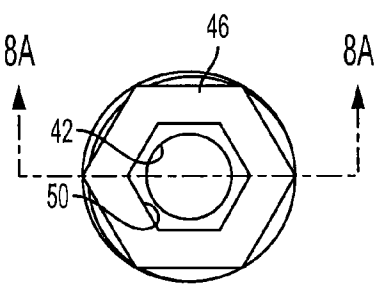
FIG. 8 is a top plan view of the bolt of the insulation piercing connector of FIG. 2 prior to being threadingly engaged with the connector body of the insulation piercing connector.
Figure 8A:
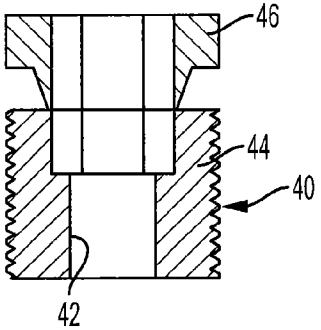
FIG. 8A is a cross-sectional view of the bolt of FIG. 8 taken along line 8A-8A of FIG. 8 and illustrating a head joined to the threaded shank of the bolt by a shear-off section.

The illustrated connector body 20 in FIGS. 6C and 7C also includes a bolt over travel notch 27. The bolt over travel notch 27 provides extra distance for the bolt 40 in FIG. 8A to be inserted into the connector body 20, and allows the bolt 40 to contact the conductor with the correct amount of force to be sheared at the specific torque value. Without the over travel notch 27, the bolt 40 may bottom out in the connector body 20 before it is able to apply a required force on the conductor. The stop 25 is used for the two-stage piercing pin 160-bolt 40 sub-assembly illustrated in FIG. 18. A portion of the bolt 40 will bottom out in the connector body 20 in order to break through the first shear plane $P_1$, then drive the piercing pin 160 into the conductor and shear at the second shear plane $P_2$, as described below.

Figure 15:
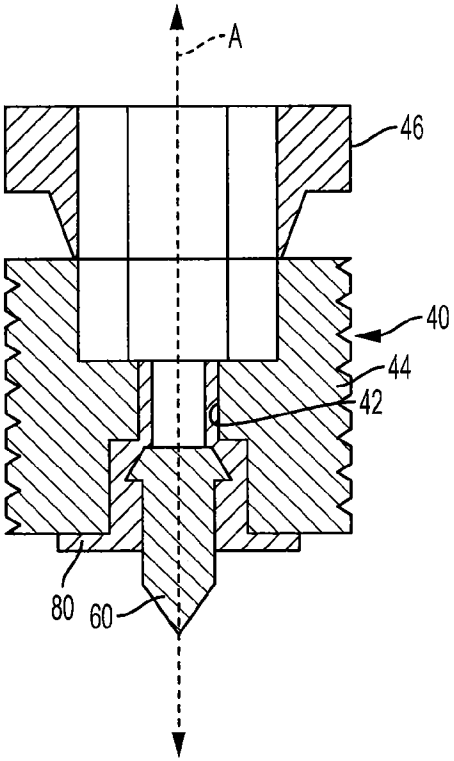
FIG. 15 is a cross-sectional view of a bolt for an insulation piercing connector, according to some embodiments of the present invention, and illustrating a piercing pin supported within the central bore of the bolt by an insulator member, and also illustrating a head joined to the threaded shank of the bolt by a shear-off section.
Figure 19:
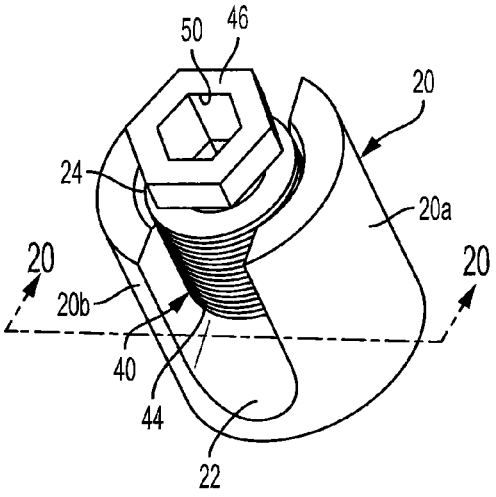
FIG. 19 is a perspective view of an insulation piercing connector, according to some embodiments of the present invention.
Figure 20:
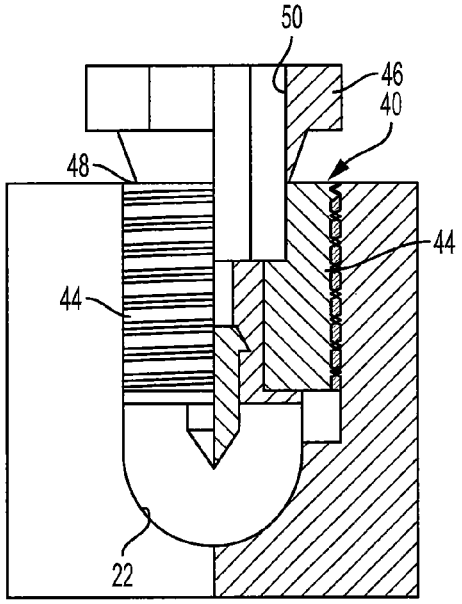
FIG. 20 is a cross-sectional view of the insulation piercing connector of FIG. 19 taken along line 20-20 of FIG. 19.

Referring back to FIGS. 1-3, the bolt 40 includes a threaded shank 44 that is threadingly engaged within the threaded bore 24 of the connector body 20. The bolt 40 defines a longitudinal axis A (FIG. 2) and the central bore 42 of the bolt is coincident with the longitudinal axis A. In some embodiments, as illustrated in FIGS. 15, 19 and 20, the bolt 40 includes a head 46 that is joined to the threaded shank 44 by a shear-off section 48. The bolt head 46 is configured to be sheared off by a torque exceeding a predetermined value as the threaded shank 44 of the bolt 40 is threadingly engaged within the threaded bore 24 of the connector body 20.

The bolt head 46 of the illustrated embodiment has a hexagonal shape such that the bolt 40 can be turned with a wrench so as to threadingly secure the bolt 40 within the threaded bore 24 of the connector body 20. In addition, the bolt head 46 of the illustrated embodiment includes a socket 50 that can be engaged by an Allen wrench or other device and such that the bolt 40 can be turned with the Allen wrench or other device so as to threadingly secure the bolt 40 within the threaded bore 24 of the connector body 20. In the illustrated embodiment, the socket 50 has a hexagonal configuration, although other configurations are possible.

Referring back to FIGS. 1-3, the piercing pin 60 is disposed within the central bore 42 of the bolt 40, and is held in place via the insulator member 80. The piercing pin 60 includes opposite first and second ends 62, 64, and the first end 62 has a pointed or conical shape configured to pierce the insulation (e.g., I, FIG. 24) of an electrical cable (e.g., EC, FIG. 24) extending through the cable receiving slot 22 and contact a conductor (e.g., C, FIG. 24) beneath the insulation. Piercing pins 60 in accordance with embodiments of the present invention can have various lengths depending on the size of an electrical cable and/or conductor, the thickness of the insulation, etc. For example, in the embodiment illustrated in FIGS. 1-3, the piercing pin 60 can be interchangeable with other piercing pins of different lengths and/or configurations.

Figure 12A:
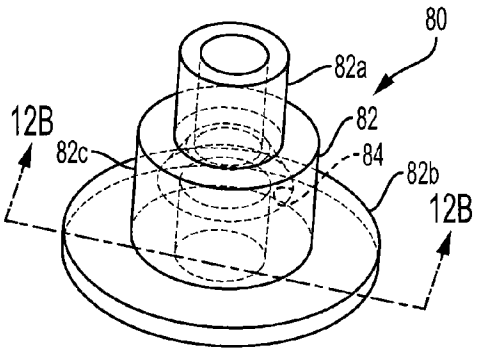
FIG. 12A is a top perspective view of an insulator member that is configured to support a piercing pin within an insulation piercing connector, according to some embodiments of the present invention.
Figure 12B:
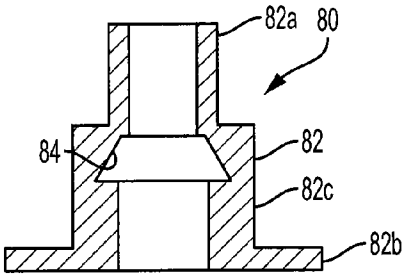
FIG. 12B is a cross-sectional view of the insulator member of FIG. 12A taken along line 12B-12B of FIG. 12A.

Several piercing pin configurations are illustrated in FIGS. 10-10A and 11-11A. In the embodiment illustrated in FIGS. 10-10A, the second end 64 of the piercing pin 60 has a tapered configuration. In the embodiment illustrated in FIGS. 11-11A, the second end 64 of the piercing pin 60 has a generally cylindrical configuration. These tapered and cylindrical configurations are configured to match a corresponding receiving portion 84 of an insulator member 80. For example, as illustrated in FIG. 12B, the insulator member 80 includes a tapered receiving portion 84 that is configured to receive the tapered second end 64 of the piercing pin 60 of FIGS. 10-10A and hold the piercing pin 60 securely within the insulator member 80. Similarly, as illustrated in FIGS. 13B and 14B, each insulator member 80 includes a cylindrical receiving portion 84 that is configured to receive the cylindrical second end 64 of the piercing pin 60 of FIGS. 11-11A and hold the piercing pin 60 securely within the insulator member 80.

The insulator member 80 is formed from insulating material, such as rubber, and can have various configurations as illustrated in FIGS. 12A-12B, 13A-13B and 14A-14B. For example, in FIGS. 12A-12B, the insulator member 80 includes a body 82 having opposite first and second cylindrical end portions 82*a*, 82*b* separated by a medial cylindrical portion 82*c*. The first end portion 82*a* is configured to be inserted within the first portion 42*a* of the central bore 42 of the bolt 40 illustrated in FIGS. 1-3. The medial portion 82*c* is configured to inserted within the second portion 42*b* of the central bore 42 of the bolt 40 illustrated in FIGS. 1-3. The second end portion 82*b* extends outwardly from the lower end 40*b* of the bolt 40 and is configured to engage an electrical cable extending through the slot 22 of the connector body 20 when the second end 64 of the piercing pin 60 has penetrated the insulation of the electrical cable. As illustrated the second end portion 82*b* of the insulator member 80 has a larger diameter than the other portions 82*a*, 82*c* of the insulator member 80 and is configured to extend across substantially the entire width of the slot 22 and engage the respective opposing wings 20*a*, 20*b* of the connector body 20. The medial portion 82*c* of the insulator member of FIGS. 12A-12B contains a tapered receiving portion 84 that is configured to receive the tapered second end 64 of the piercing pin 60 of FIGS. 10-10A.

Figure 13A:
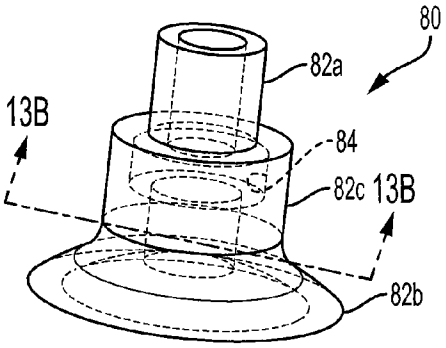
FIG. 13A is a top perspective view of an insulator member that is configured to support a piercing pin within an insulation piercing connector, according to some embodiments of the present invention.
Figure 13B:
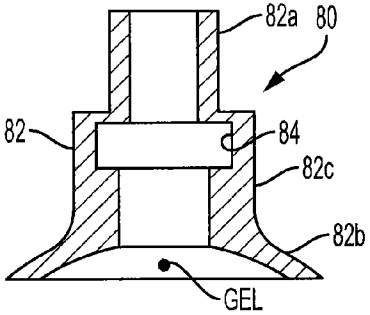
FIG. 13B is a cross-sectional view of the insulator member of FIG. 13A taken along line 13B-13B of FIG. 13A.

In FIGS. 13A-13B, the insulator member 80 includes a body 82 having a first cylindrical end portion 82*a* and an opposite second end portion 82*b* separated by a cylindrical medial portion 82*c*. The first end portion 82*a* is configured to inserted within the first portion 42*a* of the central bore 42 of the bolt 40 illustrated in FIGS. 1-3. The medial portion 82*c* is configured to inserted within the second portion 42*b* of the central bore 42 of the bolt 40 illustrated in FIGS. 1-3. The second end portion 82*b* extends outwardly from the lower end 40*b* of the bolt 40 and has a rounded or dome configuration, as illustrated. The second end portion 82*b* is configured to engage an electrical cable extending through the slot 22 of the connector body 20 when the second end 64 of the piercing pin 60 has penetrated the insulation of the electrical cable. As illustrated the second end portion 82*b* of the insulator member 80 has a larger diameter than the other portions 82*a*, 82*c* of the insulator member 80 and is configured to extend across substantially the entire width of the slot 22 and engage the respective opposing wings 20*a*, 20*b* of the connector body, as illustrated in FIG. 2. The medial portion 82*c* of the insulator member of FIGS. 13A-13B contains a cylindrical receiving portion 84 that is configured to receive the cylindrical second end 64 of the piercing pin 60 of FIGS. 11-11A.

Figure 14A:
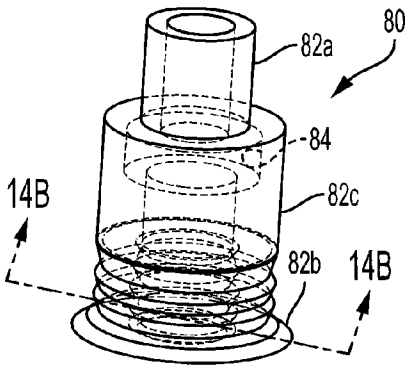
FIG. 14A is a top perspective view of an insulator member that is configured to support a piercing pin within an insulation piercing connector, according to some embodiments of the present invention.
Figure 14B:
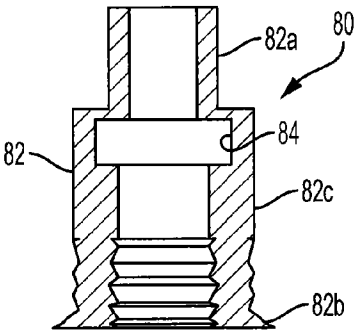
FIG. 14B is a cross-sectional view of the insulator member of FIG. 14A taken along line 14B-14B of FIG. 14A.

In FIGS. 14A-14B, the insulator member 80 includes a body 82 having a first cylindrical end portion 82*a* and an opposite second end portion 82*b* separated by a cylindrical medial portion 82*c*. The first end portion 82*a* is configured to inserted within the first portion 42*a* of the central bore 42 of the bolt 40 illustrated in FIGS. 1-3. The medial portion 82*c* is configured to inserted within the second portion 42*b* of the central bore 42 of the bolt 40 illustrated in FIGS. 1-3. The second end portion 82*b* extends outwardly from the lower end 40*b* of the bolt 40 and has an accordion configuration, as illustrated. The second end portion 82*b* is configured to engage an electrical cable extending through the slot 22 of the connector body 20 when the second end 64 of the piercing pin 60 has penetrated the insulation of the electrical cable. The medial portion 82*c* of the insulator member of FIGS. 14A-14B contains a cylindrical receiving portion 84 that is configured to receive the cylindrical second end 64 of the piercing pin 60 of FIGS. 11-11A.

A sealant, such as a sealant gel, may be utilized at the second end portions 82*b* of the insulator members 80 of FIGS. 12A-12B, 13A-13B and 14A-14B to further insulate the piercing pin and the pierced portion of the electrical cable from the environment. For example, the second end portions 82*b* of the insulator members 80 may contain a sealant gel that the piercing pin extends through as it pierces the insulation of an electrical cable within the slot 22 of the connector body 20. Various types of sealant gels may be utilized including, but not limited to, silicone gels, polyurethane gels, gels based on styrene-ethylene butylenestyrene (SEBS) or styrene-ethylene propylene-styrene (SEPS), EPDM rubber-based gels, gels based on anhydride-containing polymers, and the like. The sealant gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

Referring back to FIGS. 1-5, the illustrated insulation piercing connector 10 includes a sensor 90 that is attached to the connector body 20 after the bolt 40 has been threadingly secured within the threaded bore 24 of the connector body 20, and after piercing pin piercing end 62 has pierced the insulation of an electrical cable and contacted a conductor within the electrical cable, as described herein. The illustrated sensor 90 includes a threaded portion 92 having opposite first and second end portions 92*a*, 92*b*. A probe 94 extends outwardly from the second end portion 92*b* and is configured to contact and make electrical contact with the free end surface 66 of the piercing pin second end 64 when the threaded portion 92 is threadingly secured within the threaded portion 42*c* of the central bore 42 of the bolt 40. A head portion 96 is located at the first end portion 92*a* of the threaded portion 92 and is configured to engage the upper surface 40*a* of the bolt, as illustrated in FIGS. 2-3. A housing 98 is attached to the head portion 96 and includes a display 100 visible through an upper surface 98*a* thereof. The housing 98 also contains one or more sensors for detecting information from an electrical conductor such as, but not limited to, voltage information, current information, thermal information, etc. These sensors detect information from the conductor of an electrical cable via the piercing pin 60 which is in contact with the conductor. In addition, the housing 98 may contain a power supply such as a battery, as well as a wireless transmitter for transmitting sensor data to a remote device. The display 100 may be configured to display sensor information and may serve as a status indicator for the electrical cable.

Figure 17:
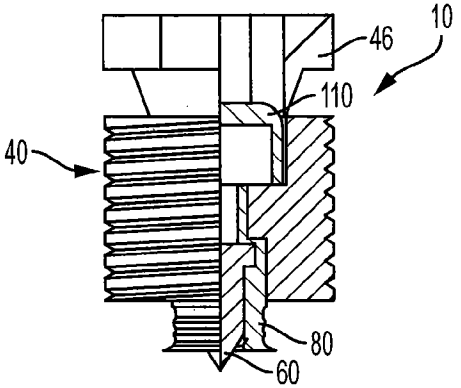
FIGS. 16 and 17 are cross-sectional views of a bolt for an insulation piercing connector, according to some embodiments of the present invention, and illustrating a piercing pin supported within the central bore of the bolt by an insulator member, and also illustrating a cap removably secured to the central bore of the bolt that seals the central bore from exposure to the environment.
Figure 16:
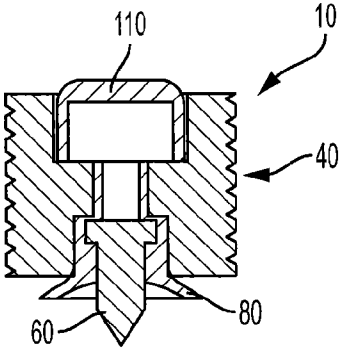
Figure 21:
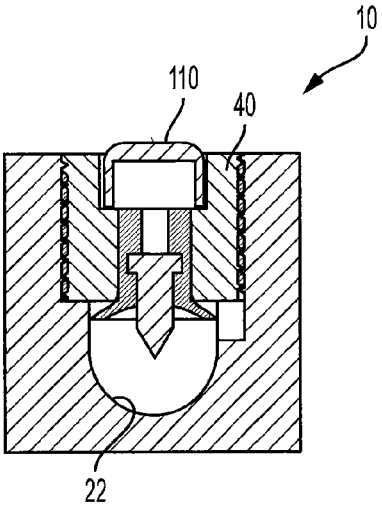
FIG. 21 is a cross-sectional view of an insulation piercing connector, according to some embodiments of the present invention, and illustrating a piercing pin supported within the central bore of the bolt by a dome-type insulator member.
Figure 22:
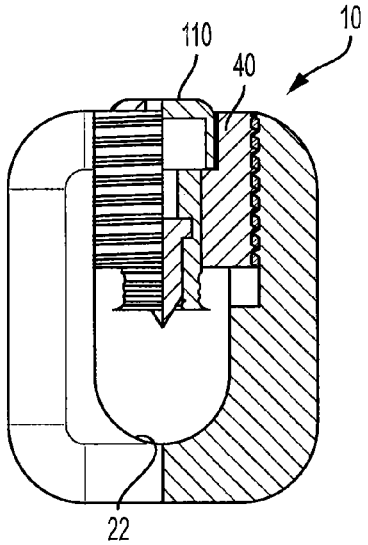
FIG. 22 is a cross-sectional view of an insulation piercing connector, according to some embodiments of the present invention, and illustrating a piercing pin supported within the central bore of the bolt by an accordion-type insulator member.

In some embodiments, the sensor 90 is configured to be threadingly secured to a connector 10 by hand. In other embodiments, a wrench may be used to secure and remove the sensor 90 to the connector 10. As illustrated in FIGS. 21 and 22, in some embodiments, a cap 110 may be removably secured to the central bore 42 of the bolt 40 after the head 46 is sheared off. In other embodiments, as illustrated in FIGS. 16 and 17, a removable cap 110 may be pre-assembled with the bolt subassembly. As such, when the head 46 is sheared off, the removable cap 110 is already in place and removably secured to the central bore 42 of the bolt 40. The cap 110 is configured to seal the central bore 42, and thus the piercing pin 60, from exposure to the environment. To obtain information from an electrical cable positioned within the connector body slot 22 and to which the connector 10 is attached, the cap 110 is removed and a sensor 90 is threadingly secured within the threaded portion 42*c* of the central bore 42, as described above. Upon removal of the sensor 90, the cap 110 may again be secured to the central bore 42.

Figure 9:
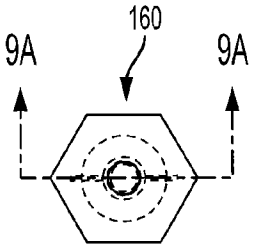
FIG. 9 is a top plan view of a piercing pin that can be utilized with an insulation piercing connector, according to some embodiments of the present invention.
Figure 9A:
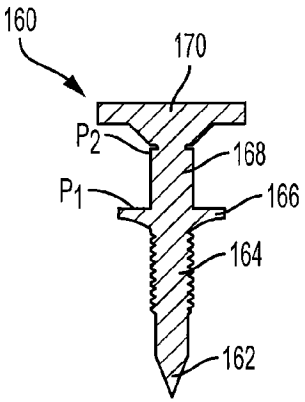
FIG. 9A is a cross-sectional view of the piercing pin of FIG. 9 taken along line 9A-9A of FIG. 9.
Figure 23:
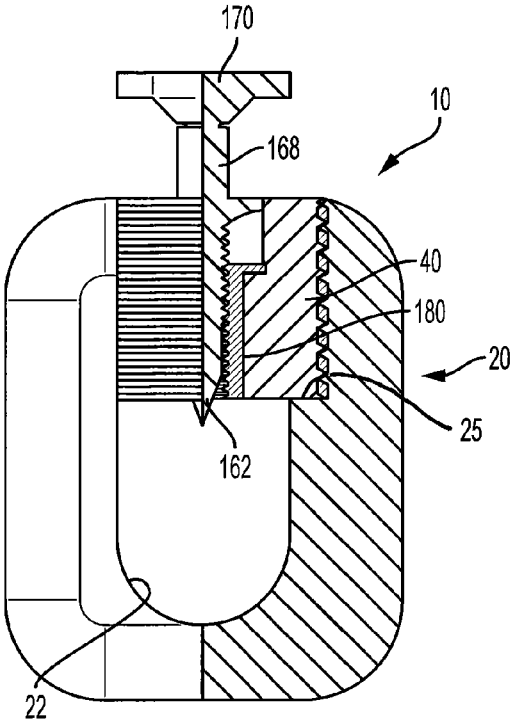
FIG. 23 is a cross-sectional view of an insulation piercing connector, according to some embodiments of the present invention, and illustrating a piercing pin that is utilized to threadingly engage the bolt within a connector body of the insulation piercing connector.
Figure 24:
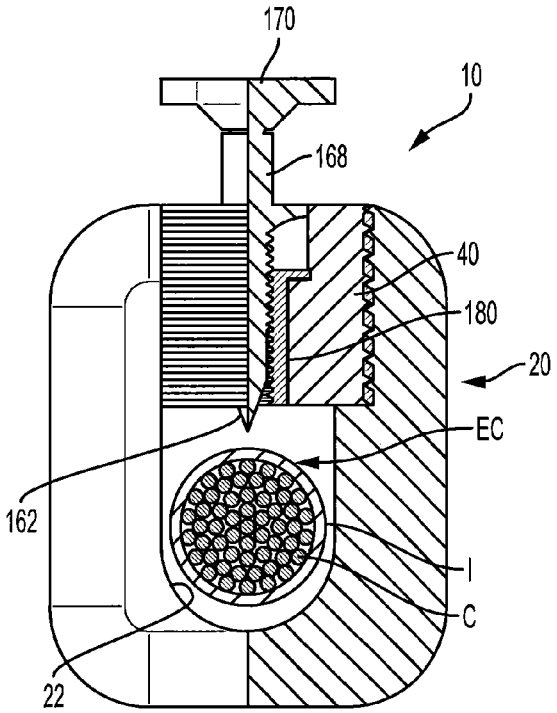
FIG. 24 is a cross-sectional view of an insulation piercing connector, according to some embodiments of the present invention, with an electrical cable positioned within the cable receiving slot of the connector body, and illustrating a piercing pin that is utilized to threadingly engage the bolt within the connector body and pierce the insulation of the electrical cable.

Referring now to FIGS. 9, 9A, 18, 23 and 24, a connector 10 for an electrical cable having a piercing pin 160 according to other embodiments of the present invention will be described. The illustrated piercing pin 160, when rotated via a wrench, is configured to threadingly rotate the bolt 40 into the connector body 20 until the bolt reaches the stop 25 and then continue on rotating so that the piercing end 162 pierces the insulation I (FIG. 24) of an electrical cable EC (FIG. 24) extending through the cable receiving slot 22 of the connector body 20 (FIGS. 23, 24). As illustrated in FIGS. 9-9A, the piercing pin 160 includes a piercing end 162, a threaded intermediate portion 164, a radially enlarged portion 166, a shear-off portion 168, and a head portion 170. The piercing end 162 has a pointed or conical shape configured to pierce the insulation I of the electrical cable EC extending through the cable receiving slot 22 of the connector body 20 (FIGS. 23, 24) and contact the conductor C (FIG. 24) beneath the insulation I. The head portion 170 in the illustrated embodiment has a hexagonal shape that is configured to be engaged by a wrench or other tool so that the piercing pin can be rotated via the wrench or other tool.

Figure 18:
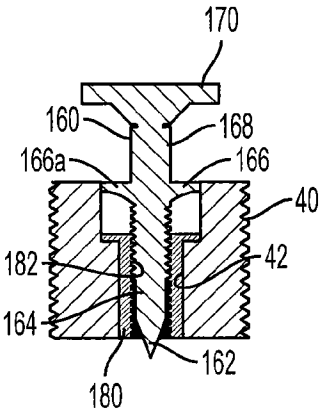
FIG. 18 is a cross-sectional view of a bolt for an insulation piercing connector, according to some embodiments of the present invention, and illustrating a piercing pin that is utilized to threadingly engage the bolt within a connector body of the insulation piercing connector.

As shown in FIGS. 18, 23 and 24, a bushing 180 having a threaded bore 182 is disposed within the central bore 42 of the bolt 40. The threaded intermediate portion 164 of the piercing pin 160 is threadingly engaged with the threaded bore 182 of the bushing 180. Frictional engagement of the threaded intermediate portion 164 with the threaded bore 182 of the bushing 180 is sufficient to cause the bushing 180 to rotate the bolt 40 as the piercing pin 160 is being rotated until the bolt reaches the stop(s) 25 in the connector body. Once the bolt 40 reaches the stop(s) 25, continued rotation of the piercing pin 160 within the threaded bore 182 of the bushing 180 causes the piercing end 162 to continue its travel so that it can pierce the insulation I (FIG. 24) of the electrical cable EC (FIG. 24) extending through the cable receiving slot 22 of the connector body 20 (FIGS. 23, 24). The shear-off portion 168 including the head portion 170 is configured to be sheared off by a torque exceeding a predetermined value after the piercing end 162 makes contact with the conductor C of the electrical cable EC. When the shear-off portion 168 is sheared off, a surface 166*a* of the radially enlarged portion 166 is exposed. This surface 166*a* is configured to be contacted by the probe 94 of a sensor 90, as described above.

The illustrated piercing pin 160 includes first and second shear planes $P_1$, $P_2$ (FIG. 9A). The piercing pin 160 will be pre-assembled into a sub-assembly, as shown in FIG. 18. The illustrated sub-assembly of FIG. 18 will then be installed into a connector body 20 where it will bottom out on the stop 25 in the connector body 20. Once this happens, the first shear plane $P_1$ will then be sheared, allowing the piercing pin 160 to begin driving into the electrical cable insulation I (FIG. 24) using threaded bore 182. Once the piercing pin 160 is driven into the conductor C (FIG. 24) and hits a certain torque value, the second shear plane $P_2$ will then shear off the head portion 170 which can then be either capped or a sensor can then be mounted for measurement readings.

Insulation piercing connectors according to embodiments of the present invention are advantageous over conventional connectors because the robust wrap-around design facilitates easy installation on existing power lines and without requiring special installation tools. Moreover, no cable stripping or cutting is required. Furthermore, insulation piercing connectors according to embodiments of the present invention facilitate the use of sensors for monitoring electrical distribution systems.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An insulation piercing connector for an electrical cable, the connector comprising:

a connector body comprising a cable receiving slot and a threaded bore communicating with the cable receiving slot;

a bolt that defines a longitudinal axis, wherein the bolt comprises a threaded shank, a central bore coincident with the longitudinal axis, and a head that is joined to the threaded shank by a shear-off section, wherein the threaded shank is threadingly engaged with the threaded bore, and wherein the head is configured to be sheared off by a torque exceeding a predetermined value as the bolt is rotated in a first direction;

a piercing pin disposed within the central bore of the shank, wherein the piercing pin comprises opposite first and second ends, wherein the first end is configured to pierce insulation of an electrical cable extending through the cable receiving slot and contact a conductor of the electrical cable as the bolt is rotated in the first direction; and an insulator member disposed within the central bore of the bolt that electrically insulates the piercing pin from the bolt.

2. The connector of claim 1, wherein the central bore of the bolt is threaded, and further comprising a sensor threadingly secured to the central bore of the bolt, wherein the sensor comprises a probe that contacts the second end of the piercing pin to obtain information from the conductor.

3. The connector of claim 2, wherein the information comprises voltage, current, and/or thermal information.

4. The connector of claim 2, wherein the sensor comprises an electronic display that is configured to display the information obtained from the conductor.

5. The connector of claim 1, further comprising a cap that is configured to be removably secured to the central bore of the bolt after the head is sheared off, wherein the cap is configured to seal the central bore from exposure to an environment.

6. The connector of claim 1, wherein the threaded bore of the connector body comprises a stop that limits travel of the bolt into the connector body.

7. The connector of claim 1, wherein the piercing pin is supported by the insulator member.

8. The connector of claim 1, wherein the connector body has a generally cylindrical configuration or a generally rectangular configuration.

9. An insulation piercing connector for an electrical cable, the connector comprising:

a connector body comprising a cable receiving slot and a threaded bore communicating with the cable receiving slot;

a bolt that defines a longitudinal axis, wherein the bolt comprises a threaded shank threadingly engaged with the threaded bore of the connector body, and a central bore coincident with the longitudinal axis;

a bushing disposed within the central bore of the bolt, wherein the bushing comprises a threaded bore; and a piercing pin disposed within the bore of the threaded shank, wherein the piercing pin comprises opposite first and second ends, and a threaded intermediate portion between the first and second ends that is threadingly engaged with the threaded bore of the bushing, wherein the first end is configured to pierce insulation of an electrical cable extending through the cable receiving slot and contact a conductor of the electrical cable as the piercing pin is rotated in a first direction.

10. The connector of claim 9, wherein the threaded bore of the connector body comprises a stop that limits travel of the bolt into the connector body, wherein the piercing pin comprises a head that is joined to the second end of the piercing pin by a shear-off section, wherein rotation of the piercing pin head causes the threaded shank of the bolt to threadingly engage with the threaded bore of the connector body until the bolt contacts the stop, wherein continued rotation of the head causes the first end of the piercing pin to pierce the insulation of the electrical cable, and wherein the head is configured to be sheared off by a torque exceeding a predetermined value after the first end of the piercing pin contacts the conductor.

11. The connector of claim 9, wherein the bushing electrically insulates the piercing pin from the bolt.

12. The connector of claim 9, wherein the central bore of the bolt is threaded, and further comprising a sensor threadingly secured to the central bore of the bolt, wherein the sensor comprises a probe that contacts the second end of the piercing pin to obtain information from the conductor.

13. The connector of claim 12, wherein the information comprises voltage, current, and/or thermal information.

14. The connector of claim 12, wherein the sensor comprises an electronic display that is configured to display the information obtained from the conductor.

15. The connector of claim 9, wherein the connector body has a generally cylindrical configuration or a generally rectangular configuration.

16. An insulation piercing connector for an electrical cable, the connector comprising:

a connector body comprising a cable receiving slot and a threaded bore communicating with the cable receiving slot;

a bolt that defines a longitudinal axis, wherein the bolt comprises a threaded shank, a threaded central bore coincident with the longitudinal axis, and a head that is joined to the threaded shank by a shear-off section, wherein the threaded shank is threadingly engaged with the threaded bore, and wherein the head is configured to be sheared off by a torque exceeding a predetermined value as the bolt is rotated in a first direction;

a piercing pin disposed within the threaded central bore of the bolt so as to be electrically insulated from the bolt, wherein the piercing pin comprises opposite first and second ends, wherein the first end is configured to pierce insulation of an electrical cable extending through the cable receiving slot and contact a conductor of the electrical cable as the bolt is rotated in the first direction; and a sensor threadingly secured to the threaded central bore, wherein the sensor comprises a probe that contacts the second end of the piercing pin to obtain information from the conductor.

17. The connector of claim 16, wherein the information comprises voltage, current, and/or thermal information.

18. The connector of claim 16, wherein the sensor comprises an electronic display that is configured to display the information obtained from the conductor.

19. The connector of claim 16, wherein the threaded bore of the connector body comprises a stop that limits travel of the bolt into the connector body.

20. The connector of claim 16, wherein the connector body has a generally cylindrical configuration or a generally rectangular configuration.

* * * * *